US011193401B2

(12) United States Patent
Okamoto

(10) Patent No.: US 11,193,401 B2
(45) Date of Patent: Dec. 7, 2021

(54) LOST MOTION MECHANISM, VALVE GEAR AND ENGINE

(71) Applicant: YAMAHA HATSUDOKI KABUSHIKI KAISHA, Iwata (JP)

(72) Inventor: Yasuo Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/114,560

(22) Filed: Dec. 8, 2020

(65) Prior Publication Data

US 2021/0199028 A1 Jul. 1, 2021

(30) Foreign Application Priority Data

Dec. 27, 2019 (JP) ..... JP2019-239845

(51) Int. Cl.

| | |
|---|---|
| ***F01L 1/46*** | (2006.01) |
| *F01L 1/18* | (2006.01) |
| *F01L 1/26* | (2006.01) |
| *F01L 13/00* | (2006.01) |

(52) U.S. Cl.

CPC ..... *F01L 1/462* (2013.01); *F01L 1/185* (2013.01); *F01L 1/267* (2013.01); *F01L 13/0005* (2013.01); *F01L 2001/186* (2013.01); *F01L 2001/467* (2013.01)

(58) Field of Classification Search

CPC ..... F01L 1/185; F01L 2001/186; F01L 1/267; F01L 2001/467; F01L 13/0005

USPC ..... 123/90.4, 90.41, 90.44, 90.46, 90.67

See application file for complete search history.

(56) References Cited

U.S. PATENT DOCUMENTS

| | | | | |
|---|---|---|---|---|
| 5,099,806 | A * | 3/1992 | Murata | F01L 13/0005 123/90.16 |
| 2006/0283412 | A1* | 12/2006 | Tsuruta | F01L 1/267 123/90.16 |
| 2009/0151685 | A1* | 6/2009 | Oh | F01L 1/143 123/188.2 |
| 2009/0205598 | A1 | 8/2009 | Takahashi et al. | |
| 2013/0042830 | A1* | 2/2013 | Kawata | F01L 1/267 123/90.16 |

(Continued)

FOREIGN PATENT DOCUMENTS

| | | | | |
|---|---|---|---|---|
| DE | 101 12 980 | A1 | 9/2002 | |
| DE | 10112980 | A1 * | 9/2002 | F01L 1/46 |

(Continued)

OTHER PUBLICATIONS

Okamoto, "Valve Gear and Engine", U.S. Appl. No. 17/114,559, filed Dec. 8, 2020.

(Continued)

*Primary Examiner* — Jorge L Leon, Jr.

(74) *Attorney, Agent, or Firm* — Keating and Bennett, LLP

(57) ABSTRACT

A valve gear includes a lost motion mechanism including a lost motion spring. A pillar is inserted into the lost motion spring, and a seat supports a lower end portion of the lost motion spring. A protrusion is provided on an opposite side of the seat from the lost motion spring. When viewed from an axial direction of the lost motion mechanism, the protrusion does not project out of the seat. By fitting the protrusion into the recess of the cylinder head, the seat, i.e., the lost motion mechanism is attached to the cylinder head.

21 Claims, 18 Drawing Sheets

(56) References Cited

U.S. PATENT DOCUMENTS

| | | | | |
|---|---|---|---|---|
| 2017/0298784 | A1 | 10/2017 | Okamoto | |
| 2017/0298787 | A1* | 10/2017 | Okamoto | F01L 1/185 |
| 2019/0301312 | A1 | 10/2019 | Schmid | |

FOREIGN PATENT DOCUMENTS

| | | | |
|---|---|---|---|
| EP | 1 712 748 | A1 | 10/2006 |
| EP | 2 472 075 | A1 | 7/2012 |
| EP | 3 647 557 | A1 | 5/2020 |
| FR | 1.594.168 | A | 6/1970 |
| JP | 03-267514 | A | 11/1991 |
| JP | 2001-329817 | A | 11/2001 |
| JP | 2009-091971 | A | 4/2009 |
| JP | 2009-197607 | A | 9/2009 |
| JP | 2009-264200 | A | 11/2009 |
| JP | 4931680 | B2 | 5/2012 |
| JP | 2013-151940 | A | 8/2013 |
| JP | 2016-094901 | A | 5/2016 |
| JP | 6220987 | B2 | 10/2017 |
| JP | 2019-011714 | A | 1/2019 |
| JP | 6458090 | B2 | 1/2019 |

OTHER PUBLICATIONS

Official Communication issued in corresponding European Patent Application No. 20216365.5, dated May 20, 2021.

* cited by examiner

LOST MOTION MECHANISM, VALVE GEAR AND ENGINE

CROSS REFERENCE TO RELATED APPLICATIONS

This application claims the benefit of priority to Japanese Patent Application No. 2019-239845 filed on Dec. 27, 2019. The entire contents of this application are hereby incorporated herein by reference.

BACKGROUND OF THE INVENTION

1. Field of the Invention

The present invention relates to lost motion mechanisms, valve gears, and engines, and more specifically to a lost motion mechanism for use in a valve gear that is able to change a lift amount, an opening timing, and a closing timing of a valve; to a valve gear including the same; and to an engine including the same.

2. Description of the Related Art

JP-A 2016-94901 discloses an example which is pertinent to conventional techniques of this kind. JP-A 2016-94901 discloses a variable valve gear which includes a first rocker arm attached pivotably to a rocker arm shaft, a second rocker arm attached pivotably to the rocker arm shaft adjacent to the first rocker arm, and a lost motion spring. The first rocker arm has a first roller which abuts on a first cam formed on a cam shaft, and abuts on a valve shaft of an intake valve or of an exhaust valve, via an auto lash adjuster. The second rocker arm has a second roller of the same outer diameter as of the first roller. The lost motion spring urges the second rocker arm so that the second roller of the second rocker arm will abut on a second cam formed on the cam shaft adjacent to the first cam.

According to JP-A 2016-94901, the lost motion spring is buried deeply into the cylinder head for the purpose of fixing it to the cylinder head. Therefore, it is necessary that a portion of the cylinder head where the lost motion spring is attached has an increased thickness.

SUMMARY OF THE INVENTION

Preferred embodiments of the present invention provide lost motion mechanisms that are each able to be fixed to a portion of an engine without requiring that portion of the engine where the lost motion mechanism is to be attached to have an increased thickness, as well valve gears and engines including the same.

According to a preferred embodiment of the present invention, a lost motion mechanism for an engine includes a lost motion spring; a regulator extending in an axial direction of the lost motion spring to limit bending of the lost motion spring; a support extending radially of the lost motion spring from the regulator to make contact with an end portion of the lost motion spring; and an attaching portion including at least a protrusion or a recess provided on the support to attach the support to the engine. In this structural arrangement, the attaching portion does not project out of the support when viewed from the axial direction.

In a preferred embodiment of the present invention, the support is provided with the attaching portion including the protrusion or the recess in order to attach the support to a portion of the engine. By providing the portion of the engine with a recess fittable to the protrusion or a protrusion to fit into the recess of the attaching portion, and then fitting the protrusion or the recess of the attaching portion into the recess or around the protrusion of the engine, it is possible to fix the support, i.e., the lost motion mechanism, to the portion of the engine. Also, since the attaching portion does not project out of the support when viewed from the axial direction of the lost motion spring, it is possible to make the attaching portion small and, accordingly, it is possible to make the recess or the protrusion of the engine small thus eliminating the need to increase the thickness of the portion of the engine where the lost motion mechanism is to be attached. Therefore, it is possible to fix the lost motion mechanism to the portion of the engine without increasing the thickness of that portion of the engine.

Preferably, the support includes a seat to support a lower end portion of the lost motion spring, the attaching portion is provided in the seat, and the engine includes a cylinder head to which the attaching portion is to be attached. In this case, the seat is provided with the attaching portion including the protrusion or the recess in order to attach the support to the cylinder head. By providing the cylinder head with a recess fittable to the protrusion, or a protrusion to fit into the recess, of the attaching portion, and then fitting the protrusion or the recess of the attaching portion into the recess, or around the protrusion, of the cylinder head, it is possible to fix the seat, i.e., the lost motion mechanism, to the cylinder head. Also, since the attaching portion does not project out of the seat when viewed from the axial direction of the lost motion spring, it is possible to make the attaching portion small and, accordingly, it is possible to make the recess or protrusion of the cylinder head small thus eliminating the need to increase the thickness of the cylinder head where the lost motion mechanism is to be attached.

Further preferably, the regulator includes a pillar inserted into the lost motion spring. In this case, it is possible to decrease radial dimensions of the lost motion mechanism, and to make the lost motion mechanism small.

Further, preferably, the regulator includes a cylindrical cover to cover the lost motion spring. In this case, it is possible to protect the lost motion spring and to effectively limit the bending of the lost motion spring with the cylindrical cover.

Preferably, the protrusion included in the attaching portion has a columnar or cylindrical shape, and is located on an opposite side of the support from the lost motion spring. In this case, only by providing a portion of the engine with a recess fittable to the columnar or cylindrical protrusion of the attaching portion, and fitting the protrusion of the attaching portion into the recess of the engine, it is possible to fix the lost motion mechanism to the portion of the engine. Also, since the recess of the engine may be made as a small, columnar depression corresponding to the columnar or cylindrical protrusion of the attaching portion, there is no need to increase the thickness of the portion of the engine where the lost motion mechanism is to be attached.

Further preferably, the protrusion of the attaching portion is plate-shaped and is located on an opposite side of the support from the lost motion spring. In this case, only by providing the portion of the engine with a recess fittable to the plate-shaped protrusion of the attaching portion, and fitting the protrusion of the attaching portion into the recess of the engine, it is possible to fix the lost motion mechanism to the portion of the engine. Also, the recess of the engine may be a depression including a narrow and elongated section that corresponds to the plate-shaped protrusion of the attaching portion. Therefore, it is possible to attach the lost motion mechanism even to a narrow area of the engine.

Further, preferably, the protrusion of the attaching portion includes a cross-shaped section and is located on an opposite side of the support from the lost motion spring. In this case, by providing the portion of the engine with a recess fittable to the protrusion, which has the cross-shaped section, of the attaching portion, and fitting the protrusion of the attaching portion into the recess of the engine, it is possible to reliably fix the lost motion mechanism to the portion of the engine.

Preferably, the pillar includes a hollow portion. In this case, it is possible to make the pillar light weight.

Further preferably, the lost motion mechanism includes a through-hole that extends through the regulator, the support, and the attaching portion. In this case, even if a clearance between the attaching portion of the lost motion mechanism and the portion of the engine is made small, air and oil in the clearance easily escapes through the through-hole making it possible to reliably attach the lost motion mechanism.

Also, there is provided a valve gear which includes the lost motion mechanism described above.

According to a preferred embodiment of the present invention, a valve gear includes the lost motion mechanism fixed thereto without increasing the thickness of the portion of an engine to which the lost motion mechanism is to be attached.

Further, there is provided an engine which includes the valve gear described above.

According to a preferred embodiment of the present invention, an engine includes the lost motion mechanism fixed thereto without increasing the thickness of the portion of the engine where the lost motion mechanism is to be attached.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
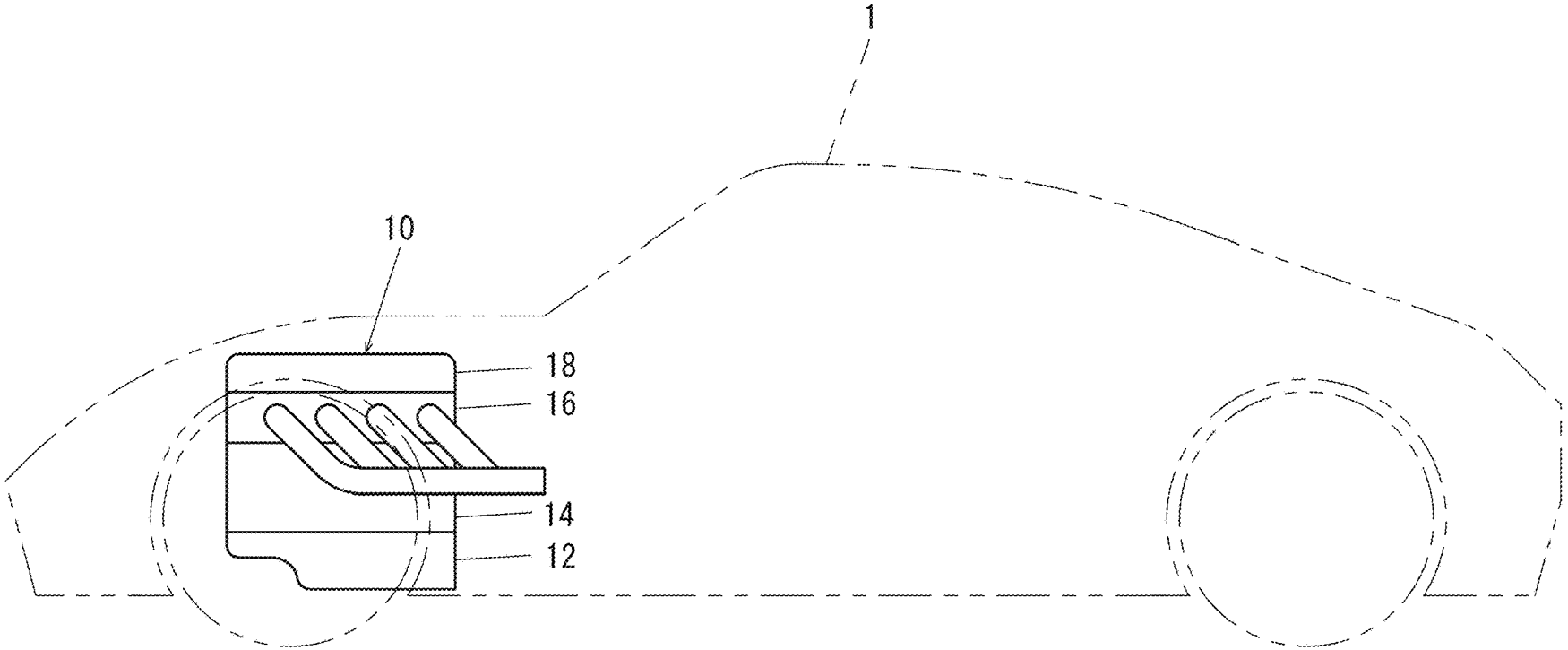
FIG. 1 is an illustrative drawing which shows an example in which an engine according to a preferred embodiment of the present invention is installed in an automobile.

Referring to FIG. 1, an engine 10 according to a preferred embodiment of the present invention is installed in an automobile 1 and is used as a propelling source of the automobile 1.

Figure 2:
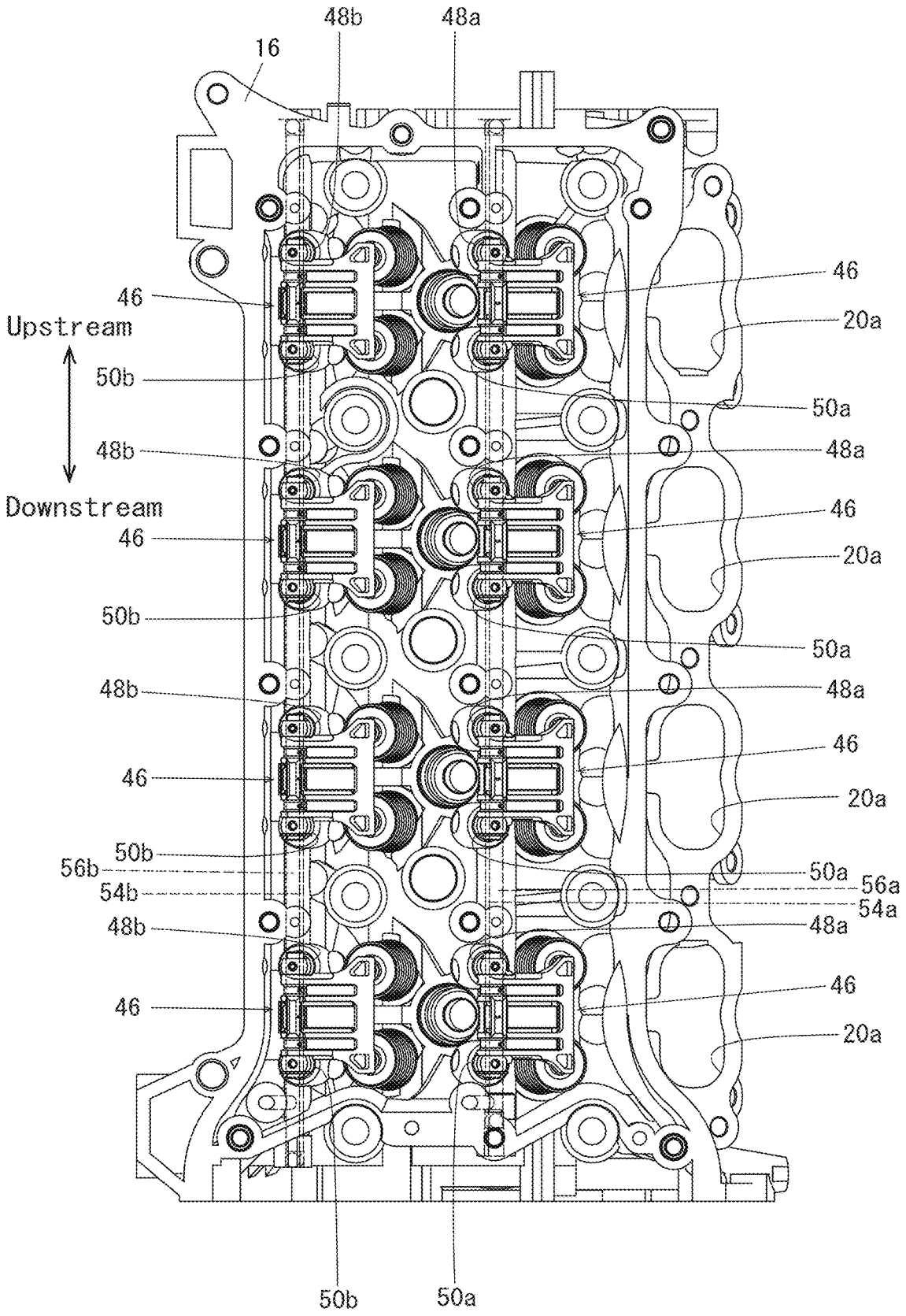
FIG. 2 is a plan view which shows a state in which valve gears, intake valves, exhaust valves and other components are attached to a cylinder head.
Figure 3:
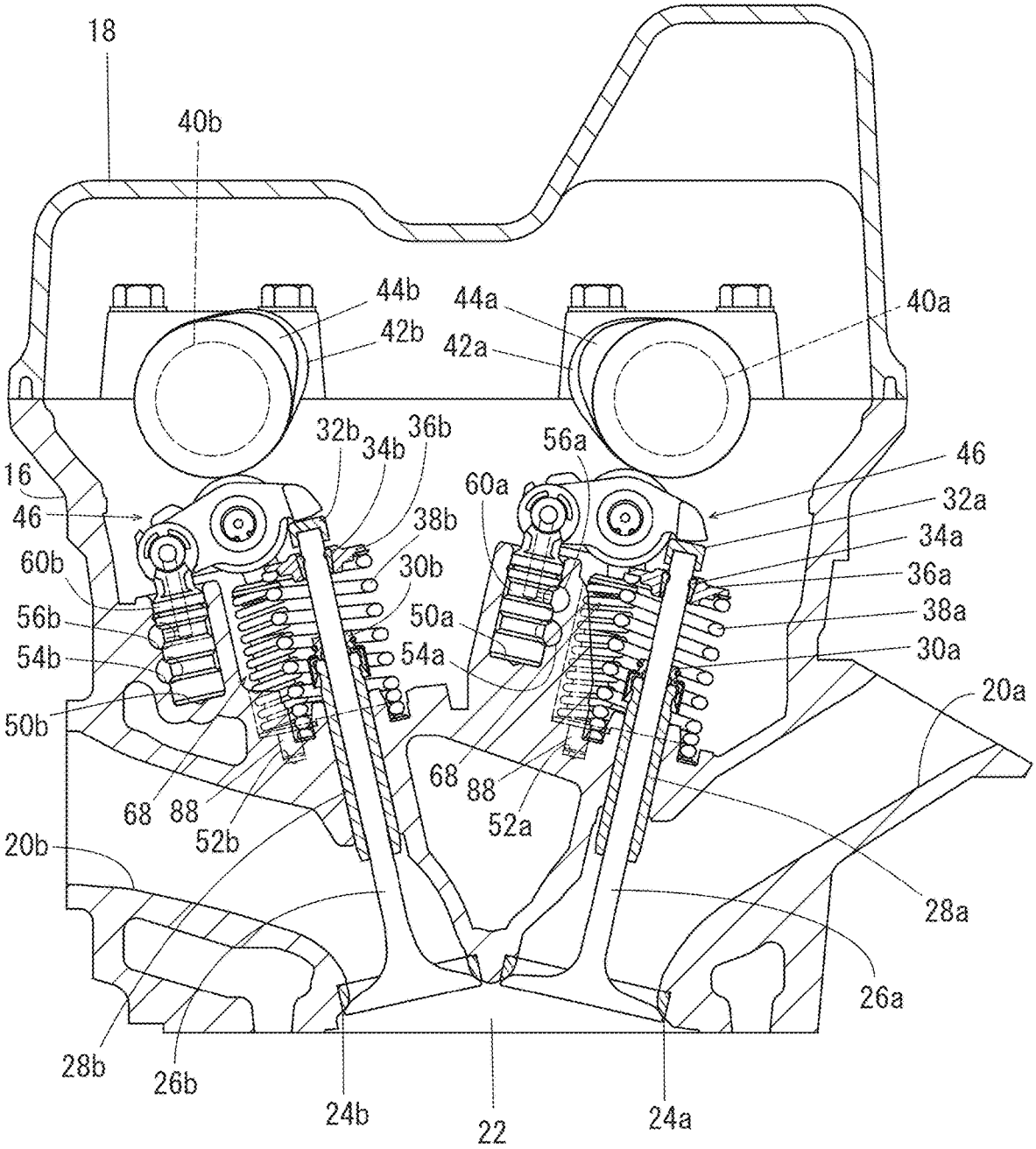
FIG. 3 is a partial sectional illustrative drawing which shows a portion of the engine.
Figure 4:
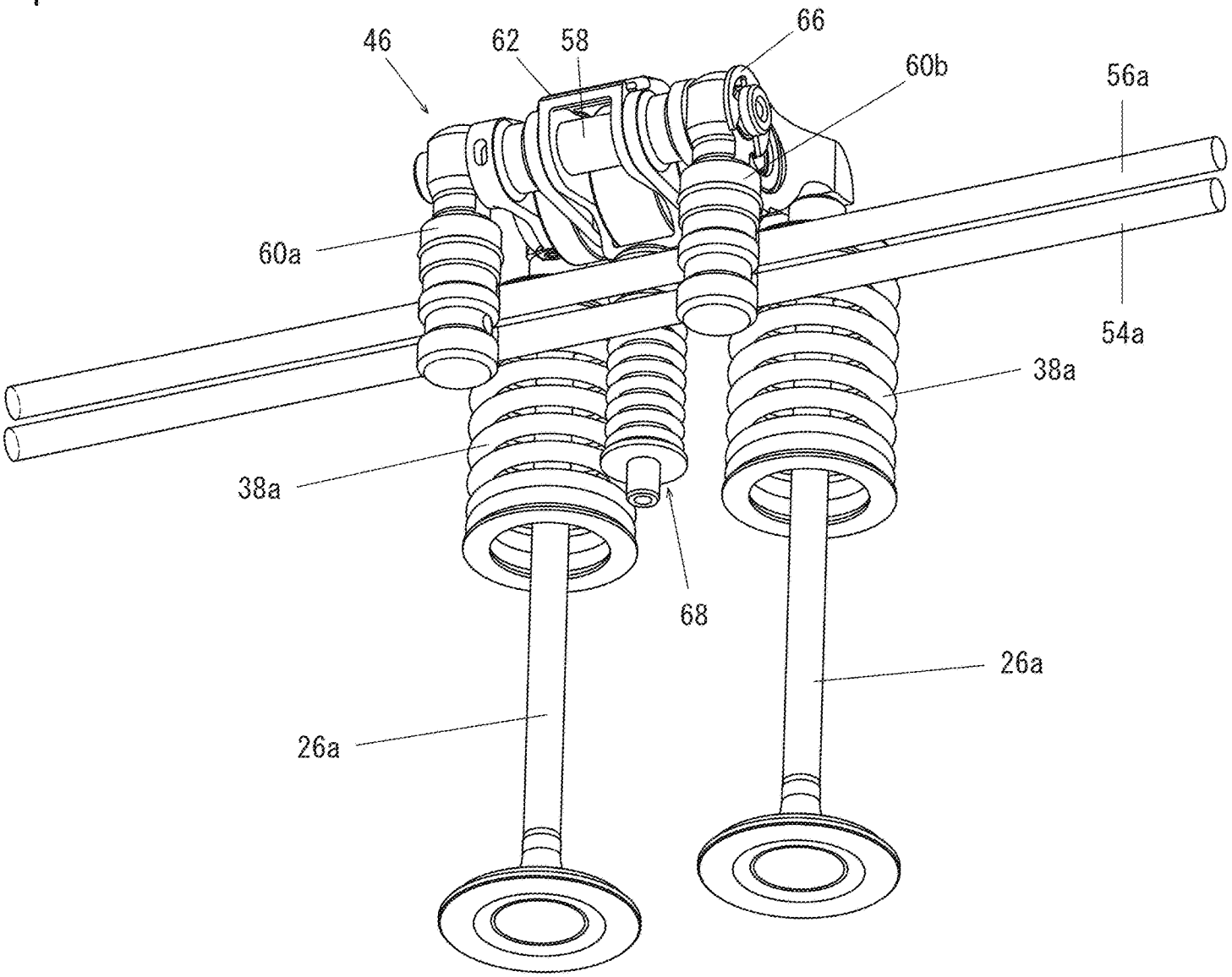
FIG. 4 is a perspective view which shows the valve gear, the intake valves, a first oil path, a second oil path and other components on an intake side according to a preferred embodiment of the present invention.
Figure 5:
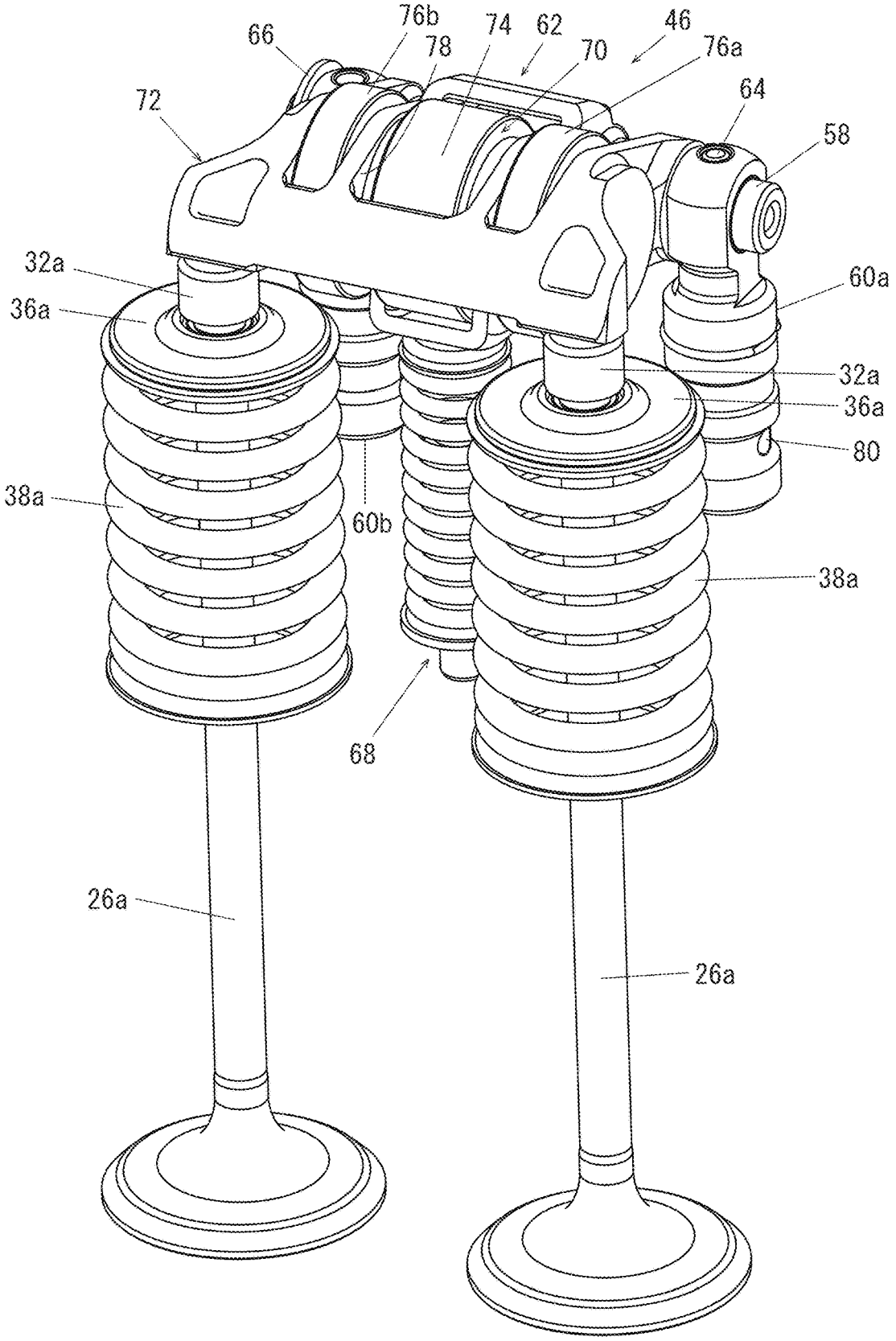
FIG. 5 is a perspective view which shows the valve gear and other components.
Figure 6:
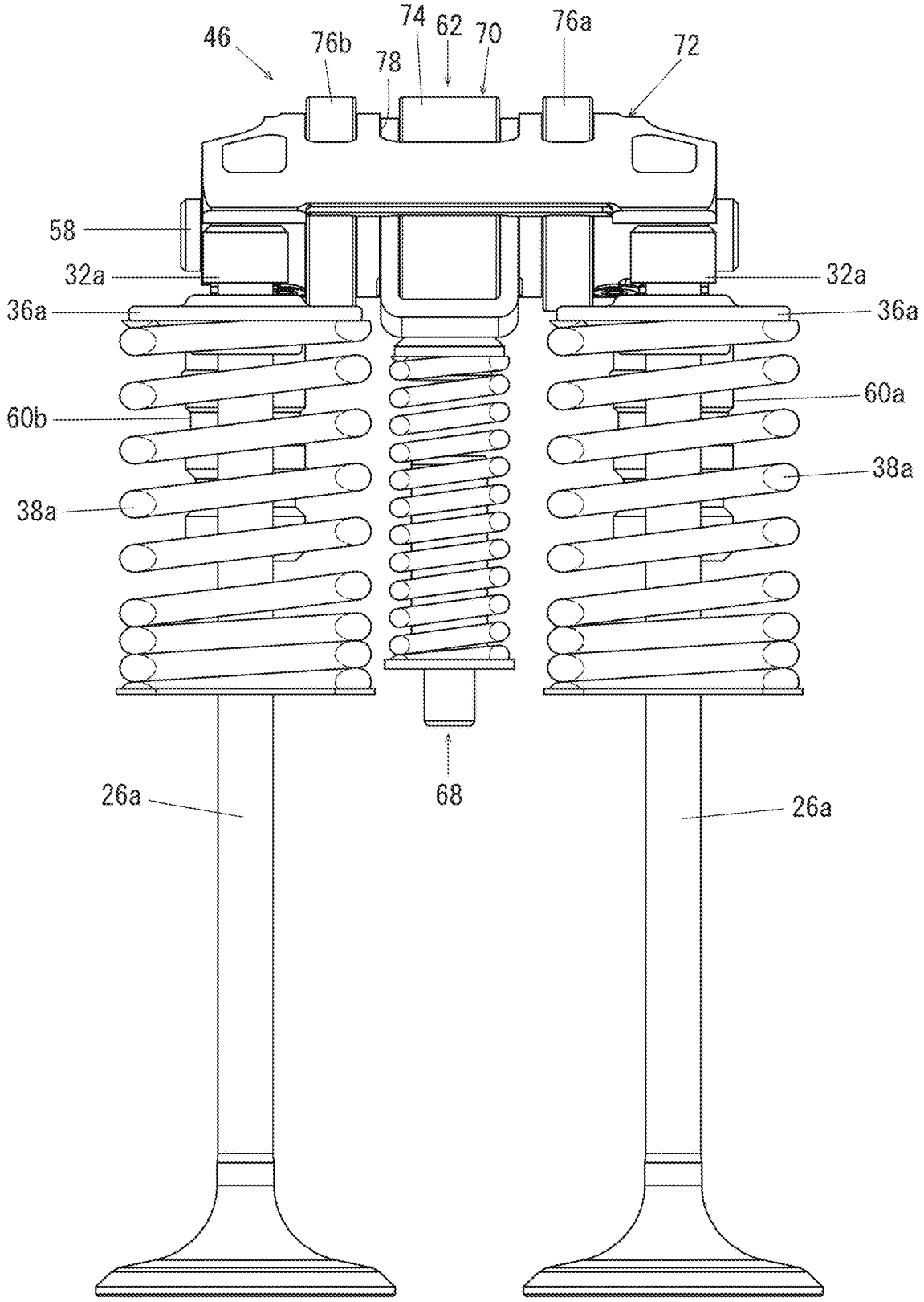
FIG. 6 is a front view which shows the valve gear and other components.
Figure 7:
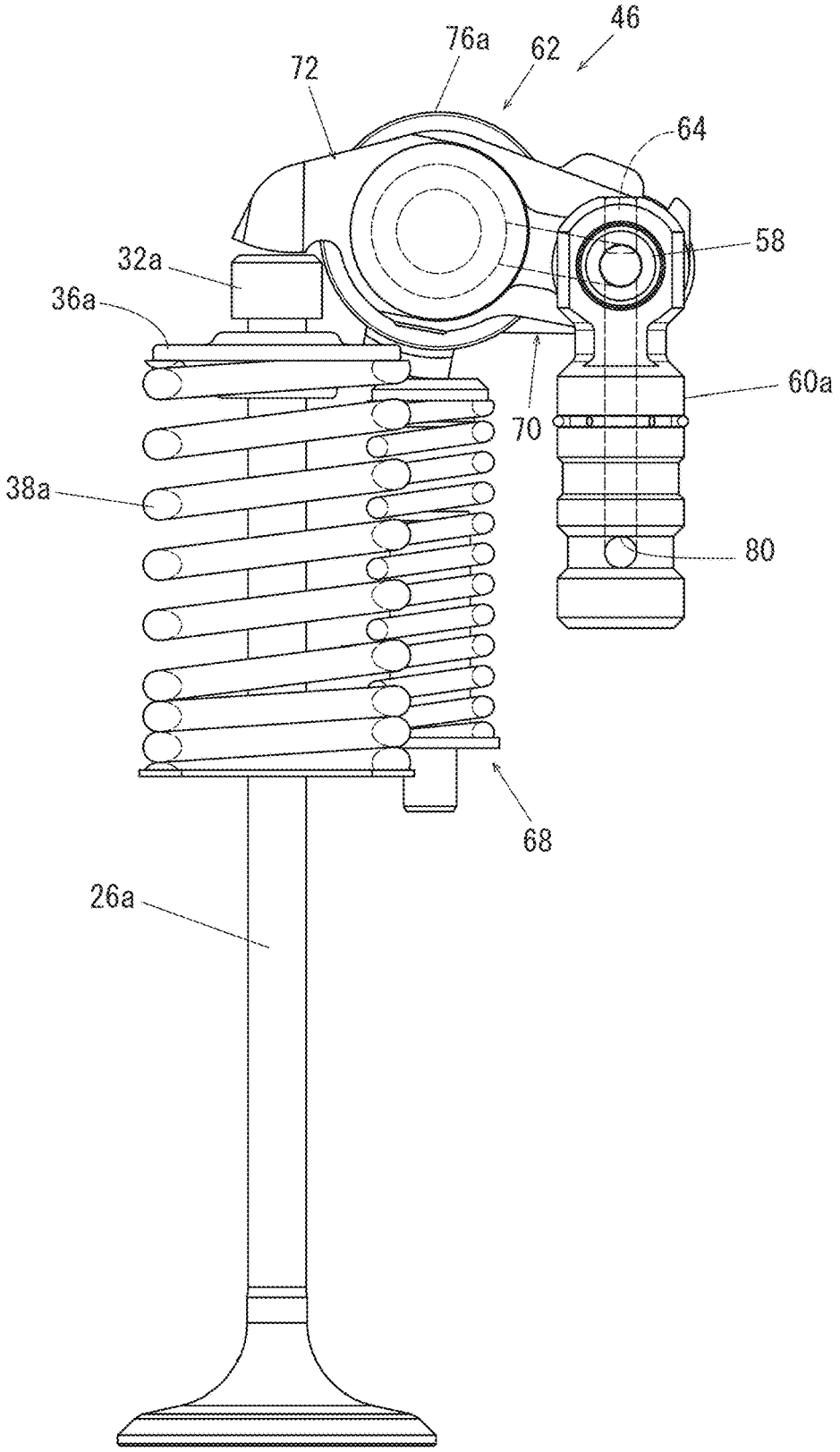
FIG. 7 is a side view which shows the valve gear and other components.
Figure 8:
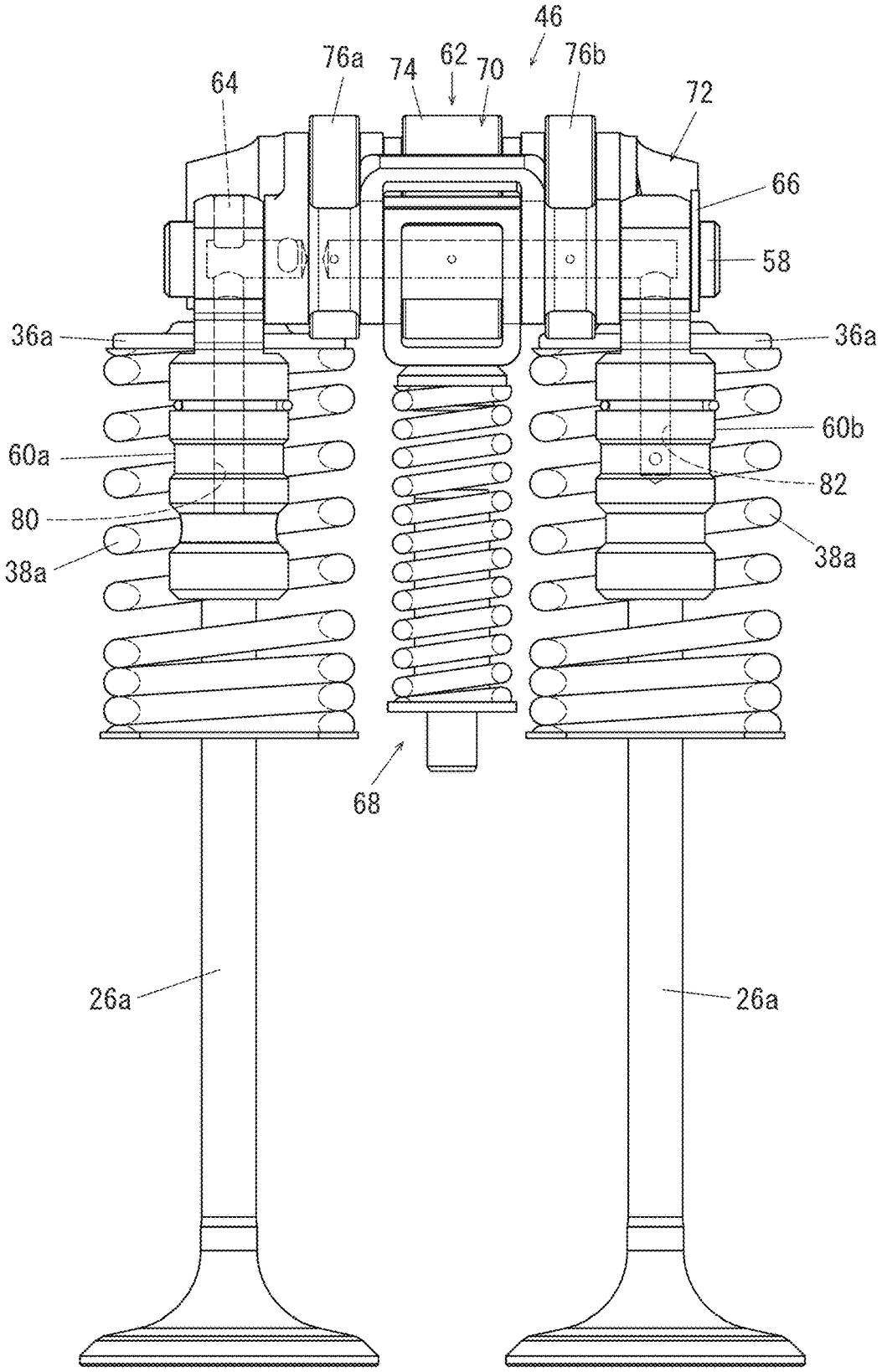
FIG. 8 is a rear view which shows the valve gear and other components.
Figure 9:
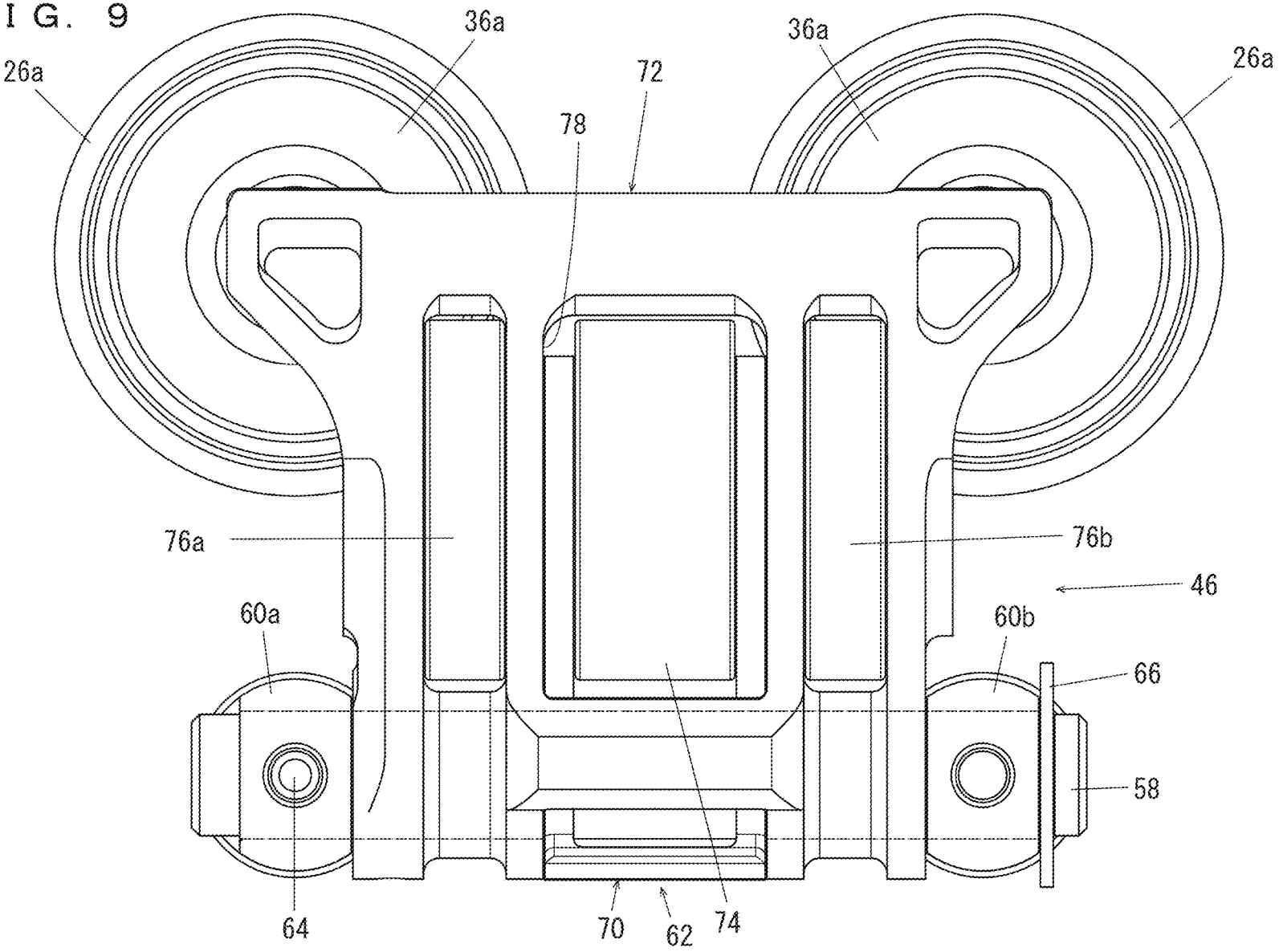
FIG. 9 is a plan view which shows the valve gear and other components.

Referring also to FIG. 2 and FIG. 3, the engine 10 is a multi-cylinder engine which includes a plurality of cylinders, and in the present preferred embodiment, is a straight four-cylinder engine. The engine 10 includes a crank case 12 which houses a crank shaft (not illustrated), a cylinder block 14 connected with the crank case 12, a cylinder head 16 connected with the cylinder block 14, and a cylinder head cover 18 attached to the cylinder head 16.

The cylinder block 14 includes a plurality of cylinders located axially along a rocker shaft 58 (which will be described below). For each cylinder, a combustion chamber 22 is provided in the cylinder block 14 and the cylinder head 16. For each combustion chamber 22, the cylinder head 16 includes an intake port 20*a* and an exhaust port 20*b*. The intake port 20*a* communicates with the combustion chamber 22 via two air inlets 24*a*, while the exhaust port 20*b* communicates with the combustion chamber 22 via two exhaust outlets 24*b*.

For each cylinder, the cylinder head 16 is provided with two intake valves 26*a* and two exhaust valves 26*b* assembled thereto. Each intake valve 26*a* opens/closes a corresponding one of the air inlets 24*a* of the intake port 20*a*, while each exhaust valve 26*b* opens/closes a corresponding one of the exhaust outlets 24*b* of the exhaust ports 20*b*.

The intake valve 26*a* is slidably supported by the cylinder head 16 via a cylindrical sleeve 28*a*. At an end of the sleeve 28*a*, on the intake valve 26*a*, a valve stem seal 30*a* is attached. A tappet 32*a* is fitted to a tip of the intake valve 26*a*. A valve spring retainer 36*a* is fixed to the intake valve 26*a* via a cotter 34*a*. Between the cylinder head 16 and the valve spring retainer 36*a*, a valve spring 38*a* is provided to urge the intake valve 26*a* with a force (in upward direction in FIG. 3) to close the air inlet 24*a*. The valve spring 38*a* is a compression coil spring. It should be noted here that the exhaust valve 26*b* and components nearby are the same as the intake valve 26*a* and those nearby. Therefore, the exhaust valve 26*b* and components nearby will not be described herein since they should be clear from the description given above by replacing the letter "a" of alphanumeric reference code of the intake valve 26*a* and other components with the letter "b".

The cylinder head 16 rotatably supports an intake cam shaft 40*a* and an exhaust cam shaft 40*b* each extending axially along the rocker shaft 58. The intake cam shaft 40*a* is provided, for each cylinder, with an intake cam 42*a* which makes sliding contact with a first arm portion 70 that will be described below, and two intake cams 44*a* which make sliding contact with a second arm portion 72 that will be described below. The exhaust cam shaft 40*b* is provided, for each cylinder, with an exhaust cam 42*b* which makes sliding contact with the first arm portion 70, and two exhaust cams 44*b* which make sliding contact with the second arm portion 72.

The cylinder head 16 is provided, for each cylinder, with a valve gear 46 for intake, and a valve gear 46 for exhaust. The valve gear 46 for intake receives a force from the intake cam 42*a* or the intake cam 44*a*, to open/close the intake valve 26*a*. The valve gear 46 for exhaust receives a force from the exhaust cam 42*b* or the exhaust cam 44*b*, to open/close the exhaust valve 26*b*.

The cylinder head 16 is provided, for each valve gear 46 for intake, with a first insertion hole 48*a* and a second insertion hole 50*a* to attach the valve gear 46, and for each valve gear 46 for exhaust, with a first insertion hole 48*b* and a second insertion hole 50*b* to attach the valve gear 46. Also, the cylinder head 16 is provided, for each valve gear 46 for intake, with a recess 52*a* to attach a lost motion mechanism 68 (which will be described below), and for each valve gear 46 for exhaust, with a recess 52*b* to attach the lost motion mechanism 68.

The cylinder head 16 is provided, on the side where the valve gears 46 for intake are located, with a first oil path 54*a* for connection-switching, and a second oil path 56*a* for lubrication; and on the side where the valve gears 46 for exhaust are located, with a first oil path 54*b* for connection-switching, and a second oil path 56*b* for lubrication. The first oil paths 54*a*, 54*b* and the second oil paths 56*a*, 56*b* extend lengthwise of the cylinder head 16, with the upstream side being an upper side in FIG. 2 and the downstream side being a lower side therein.

Hereinafter, description will cover the valve gears 46 on the intake side. The valve gears 46 on the exhaust side are configured the same way and can be easily understood, so that the duplicate description thereof will be omitted.

Referring to FIG. 4 through FIG. 9, the valve gear 46 includes the rocker shaft 58. The rocker shaft 58 includes a first end region which is supported by a first support 60*a*. The rocker shaft 58 includes a second end region which is supported by a second support 60*b*. The rocker shaft 58 pivotably supports a rocker arm 62 between the first support 60*a* and the second support 60*b*. The rocker shaft 58 and the first support 60*a* are connected with each other by a press-fit pin 64. In order to prevent the second support 60*b* from coming off the rocker shaft 58, a circlip 66 is provided on the outer side of the second support 60*b* in the rocker shaft 58. Also, the valve gear 46 includes the lost motion mechanism 68 which acts on the rocker arm 62.

The rocker arm 62 includes a first arm portion 70 and a second arm portion 72.

The first arm portion 70 is pivotably supported by the rocker shaft 58 and driven by the intake cam 42*a*. The first arm portion 70 includes a rotatable cam follower 74. The second arm portion 72 is pivotably supported by the rocker shaft 58 and drivable by the intake cam 44*a*. Further, the second arm portion 72 pivots to drive the intake valve 26*a*. The second arm portion 72 includes rotatable cam followers 76*a*, 76*b*. Also, the second arm portion 72 has its center portion provided with a recess 78. In the recess 78, the first arm portion 70 is located.

An unillustrated switch is provided inside of the first arm portion 70 and the second arm portion 72. The switch hydraulically slides a connecting pin (not illustrated) inside the rocker arm 62, thus switching the first arm portion 70 and the second arm portion 72 between a connected state and a disconnected state.

In order to supply hydraulic pressure to the switch, a third oil path 80 is provided which extends through the first support 60*a*, the rocker shaft 58, and the rocker arm 62 to the switch. Also, in order to lubricate areas between the intake cams 42*a*, 44*a* and the rocker arm 62, a fourth oil path 82 is provided which extends through the second support 60*b* and the rocker shaft 58 to a region between the rocker shaft 58 and the rocker arm 62.

The first support 60*a*, the second support 60*b*, the rocker shaft 58, and the rocker arm 62 described above are built into an assembly, which is then fixed onto the cylinder head 16 by inserting the first support 60*a* and the second support 60*b* into the first insertion hole 48*a* and the second insertion hole 50*a* respectively. Thus, in the first support 60*a*, the first oil path 54*a* and the third oil path 80 communicate with each other. Also, in the second support 60*b*, the second oil path 56*a* and the fourth oil path 82 communicate with each other.

In the valve gear 46, the switch brings the first arm portion 70 and the second arm portion 72 into the disconnected state if there is no connection-switching hydraulic pressure suppled from the third oil path 80. In the disconnected state, the first arm portion 70 and the second arm portion 72 are pivotable independently from each other around the rocker shaft 58 as a fulcrum point. On the intake side, as the intake cam shaft 40*a* rotates, the intake cam 42*a* presses the cam follower 74, which makes the first arm portion 70 pivot around the rocker shaft 58; independently from this, as the intake cam shaft 40*a* rotates, the two intake cams 44*a* press the corresponding cam followers 76*a*, 76*b*, which makes the second arm portion 72 pivot around the rocker shaft 58. Therefore, without being affected by the action of the first arm portion 70, the second arm portion 72 presses the two intake valves 26*a* such that the two air inlets 24*a* of the intake port 20*a* are opened.

On the other hand, if there is a connection-switching hydraulic pressure suppled from the third oil path 80, the switch brings the first arm portion 70 and the second arm portion 72 into the connected state. In the connected state, the first arm portion 70 and the second arm portion 72 become integrally pivotable around the rocker shaft 58. On the intake side, as the intake cam shaft 40*a* rotates, the intake cam 42*a* presses the cam follower 74, which makes the first arm portion 70 and the second arm portion 72 pivot integrally with each other around the rocker shaft 58. As a result, the second arm portion 72 presses the two intake valves 26*a* such that the two air inlets 24*a* of the intake port 20*a* are opened. In this case, the second arm portion 72 moves the intake valve 26*a* by a lift amount (an amount the valve is opened), which is determined by an amount of pivot action of the first arm portion 70 that pivots integrally with the second arm portion 72.

Figure 10:
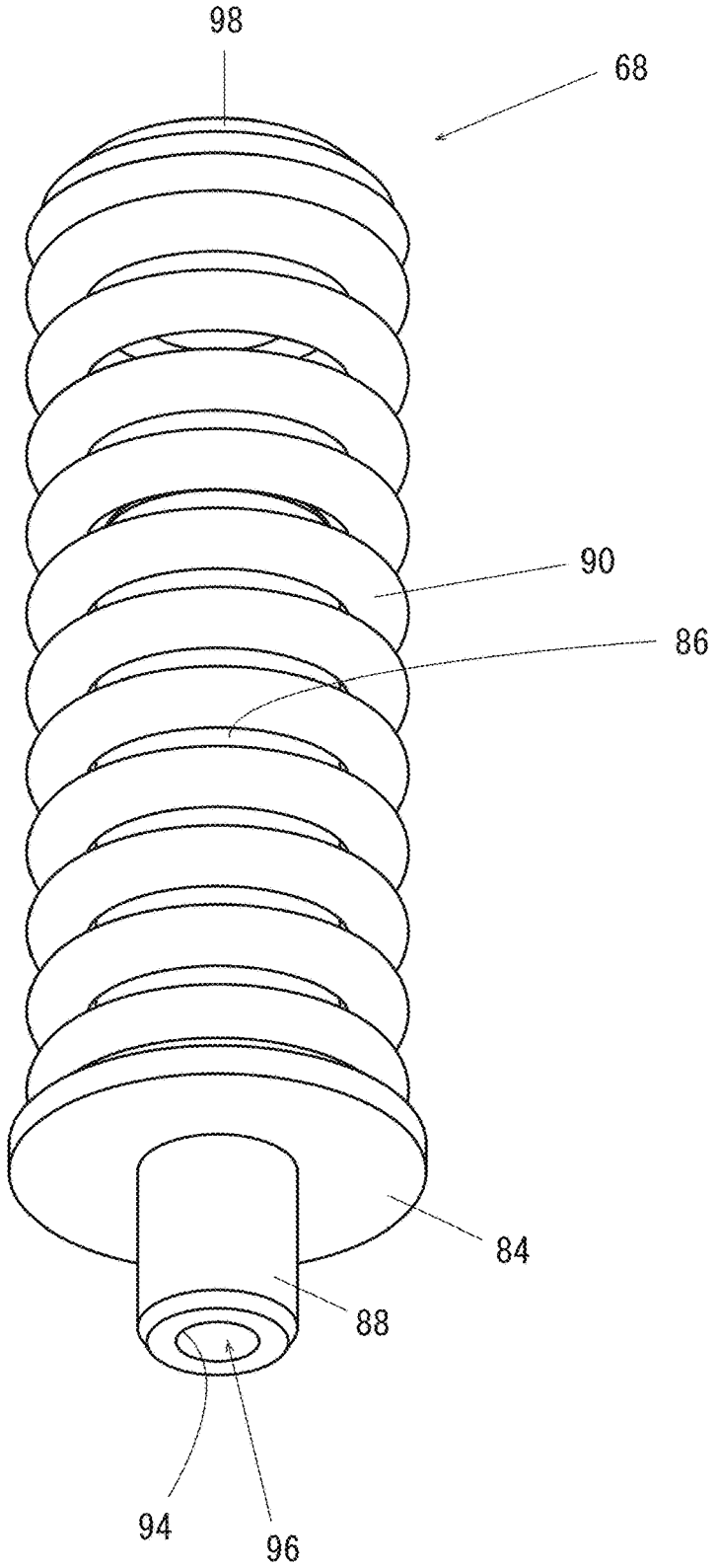
FIG. 10 is a perspective view which shows an example of a lost motion mechanism.
Figure 11:
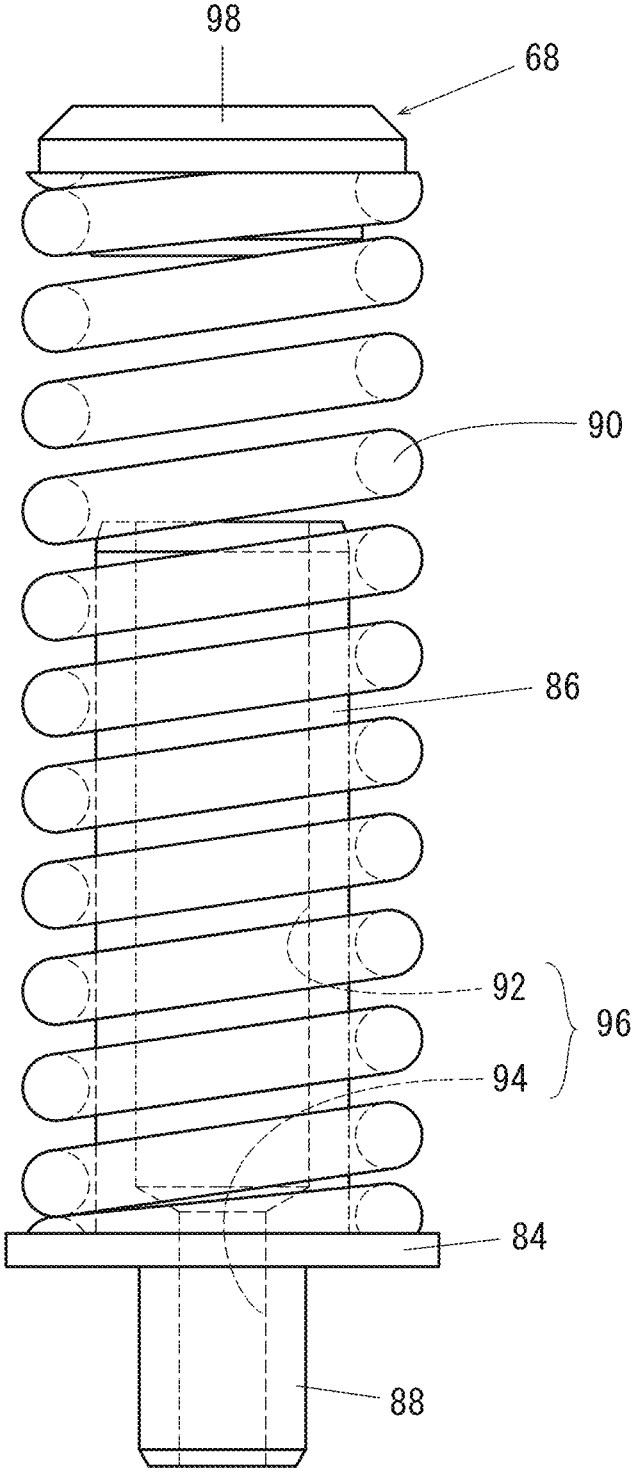
FIG. 11 is a front view which shows an example of the lost motion mechanism.
Figure 12:
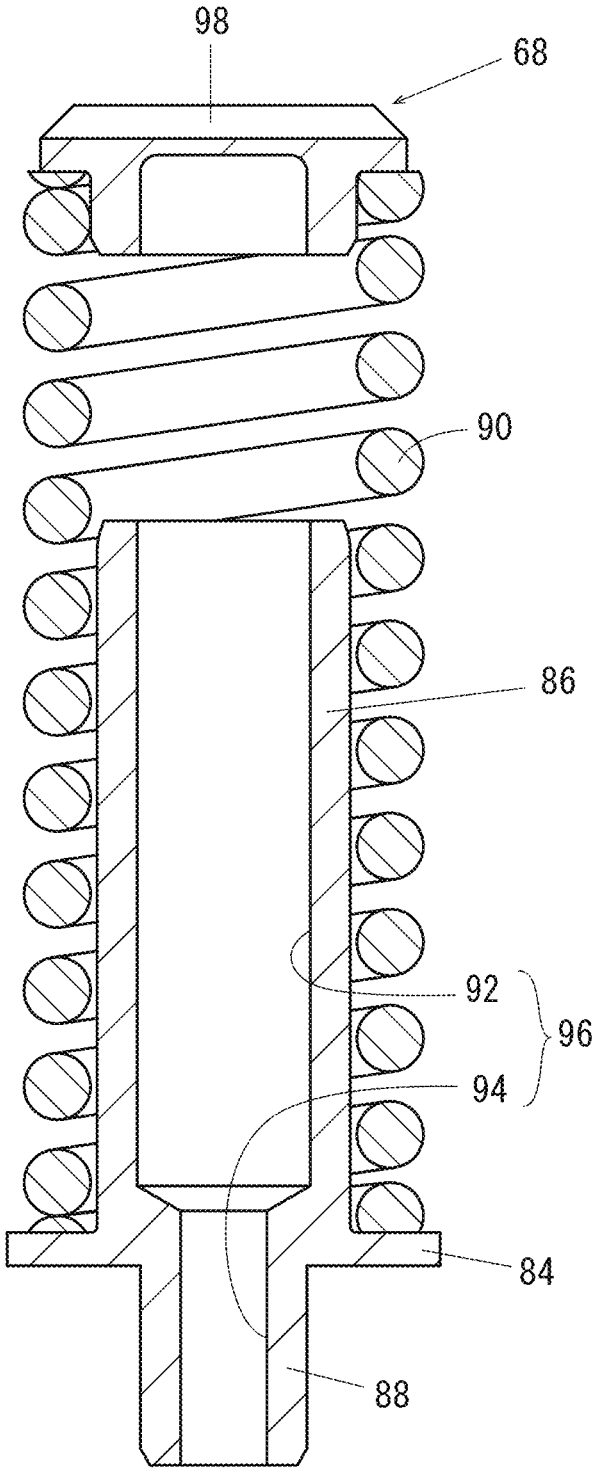
FIG. 12 is a sectional view which shows an example of the lost motion mechanism.

Referring to FIG. 10 through FIG. 12, the lost motion mechanism 68 includes a seat 84, a pillar 86, a protrusion 88, and a lost motion spring 90. The seat 84 has the shape of a hollow disc. The seat 84 includes a first main surface provided with the pillar 86 which has a hollow portion 92, while the seat 84 includes a second main surface provided with the cylindrical protrusion 88. The seat 84, the pillar 86, and the protrusion 88 are coaxial with each other. The seat 84, the pillar 86, and the protrusion 88 are provided with a through portion 94 which extends from a tip portion of the protrusion 88 to the hollow portion 92 of the pillar 86. Therefore, the hollow portion 92 and the through portion 94 define a through-hole 96 which penetrates the seat 84, the pillar 86, and the protrusion 88.

The lost motion spring 90 is a compression coil spring. The pillar 86 is inserted into the lost motion spring 90 until an end portion of the lost motion spring 90 makes contact with the seat 84. Then, the pillar 86 extending axially of the lost motion spring 90 limits bending of the lost motion spring 90, and the seat 84 extending from the pillar 86 radially of the lost motion spring 90 supports a lower end portion of the lost motion spring 90. The protrusion 88 is located on an opposite side of the seat 84 from the lost motion spring 90, and in this state, the protrusion 88 does not project out of the seat 84 when viewed from an axial direction of the lost motion spring 90.

Also, the lost motion spring 90 has its upper end portion provided with a lid 98.

The protrusion 88 of the lost motion mechanism 68 is attached to the cylinder head 16, i.e., a portion of the engine 10. By fitting the protrusion 88 into the recess 52*a* of the cylinder head 16, the seat 84, i.e., the lost motion mechanism 68, is attached to the cylinder head 16. When viewed from a longitudinal direction of the cylinder head 16, the lost motion mechanism 68 is located between the first support 60*a* (the second support 60*b*) and the intake valve 26*a* (see FIG. 3).

The lost motion spring 90 urges, via the lid 98, the first arm portion 70 of the rocker arm 62 toward the intake cam 42*a*. As the intake cam shaft 40*a* rotates, the intake cam 42*a* repeats a cycle of pushing and not pushing the first arm portion 70 of the rocker arm 62. When the first arm portion 70 is pushed downward, the first arm portion 70 pivots downward around the axial center of the rocker shaft 58. In association with this, the first arm portion 70 pushes the lost motion spring 90 via the lid 98, compressing the lost motion spring 90. The first arm portion 70 is constantly urged upward by the lost motion spring 90. Therefore, when pushed by the intake cam 42*a*, the first arm portion 70 pivots against the spring force from the lost motion spring 90. On the other hand, when the intake cam 42*a* does not push the first arm portion 70 downward, the lost motion spring 90 stretches, and the first arm portion 70 is pivoted upward by the force from the lost motion spring 90 around the axial center of the rocker shaft 58.

In the present preferred embodiment, the seat 84 corresponds to the support, the pillar 86 corresponds to the regulator, and the protrusion 88 corresponds to the attaching portion.

Figure 13:
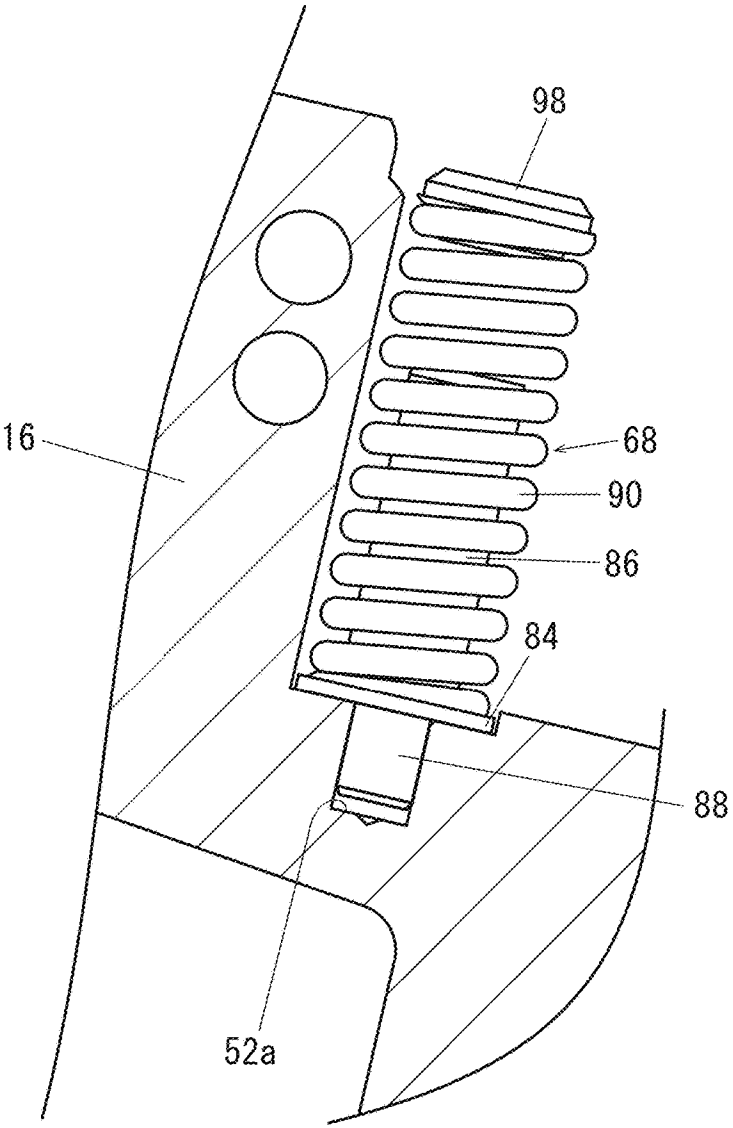
FIG. 13 is an illustrative drawing which shows the lost motion mechanism attached to the cylinder head.
Figure 13:
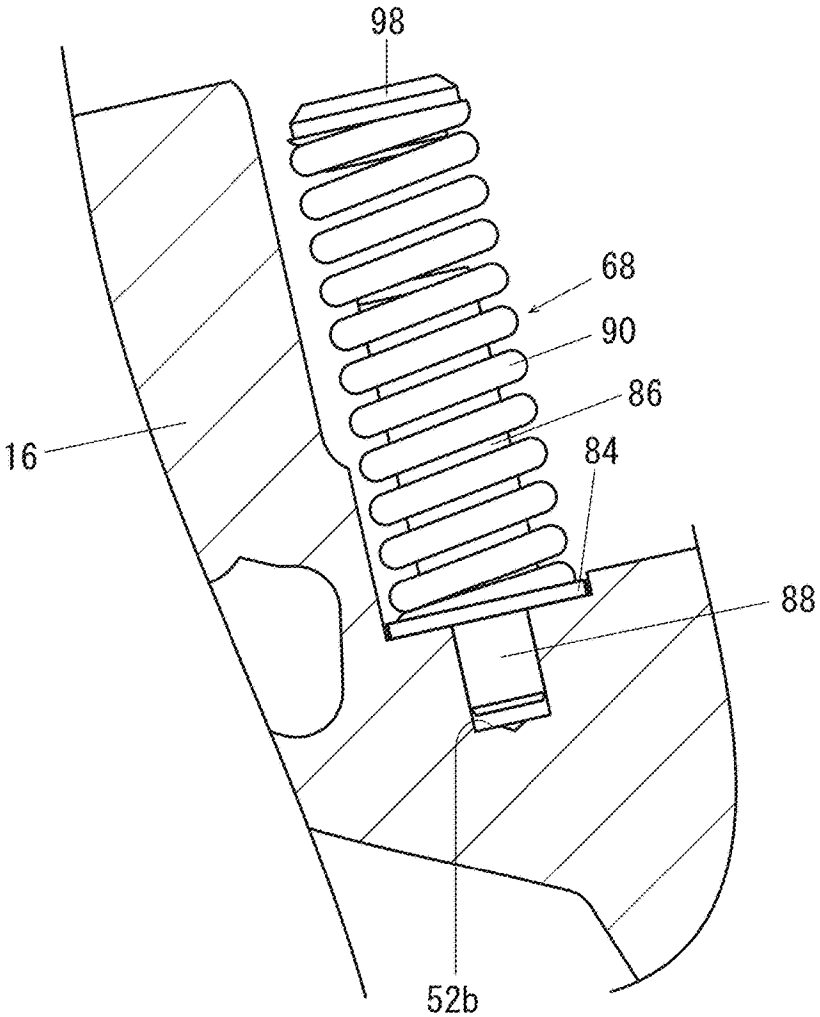

Referring to FIG. 3 and FIG. 13, according to the engine 10 which includes the lost motion mechanism 68, the seat 84 is provided with the protrusion 88 which corresponds to the attaching portion in order to attach the seat 84 which corresponds to the support to the cylinder head 16 which corresponds to the portion of the engine 10. It is possible to fix the seat 84, i.e., the lost motion mechanism 68, to the cylinder head 16 by providing the cylinder head 16 with the recess 52*a* (52*b*) which is fittable to the protrusion 88, and fitting the protrusion 88 into the recess 52*a* (52*b*) of the cylinder head 16. Also, since the protrusion 88 does not project out of the seat 84 when viewed from the axial direction of the lost motion spring 90, it is possible to make the protrusion 88 small and, accordingly, it is possible to make the recess 52*a* (52*b*) of the cylinder head 16 small thus eliminating the need to increase the thickness of the cylinder head 16 where the lost motion mechanism 68 is to be attached.

Since the pillar 86 is inserted into the lost motion spring 90, it is possible to decrease a radial dimension of the lost motion mechanism 68, which makes it possible to miniaturize the lost motion mechanism 68.

The cylindrical protrusion 88 is provided on the opposite side of the seat 84 from the lost motion spring 90. Therefore, it is possible to fix the lost motion mechanism 68 to the cylinder head 16 only by providing the cylinder head 16 with the recess 52*a* (52*b*) which is fittable to the cylindrical protrusion 88, and fitting the protrusion 88 into the recess 52*a* (52*b*) of the cylinder head 16. Also, since the recess 52*a* (52*b*) of the cylinder head 16 may be made as a small, columnar depression corresponding to the cylindrical protrusion 88, there is no need to increase the thickness of the cylinder head 16 where the lost motion mechanism 68 is to be attached.

Since the pillar 86 includes the hollow portion 92, it is possible to make the pillar 86 light weight.

The lost motion mechanism 68 includes the through-hole 96 that penetrates the pillar 86, the seat 84, and the protrusion 88. Therefore, even if a clearance between the protrusion 88 of the lost motion mechanism 68 and the cylinder head 16 is small, air and oil in the clearance easily escape through the through-hole 96 thus making it possible to reliably attach the lost motion mechanism 68.

As described above, preferred embodiments of the present invention provide the valve gear 46 and the engine 10 to which the lost motion mechanism 68 can be fixed without increasing the thickness of the cylinder head 16 to which the lost motion mechanism 68 is to be attached.

Figure 14:
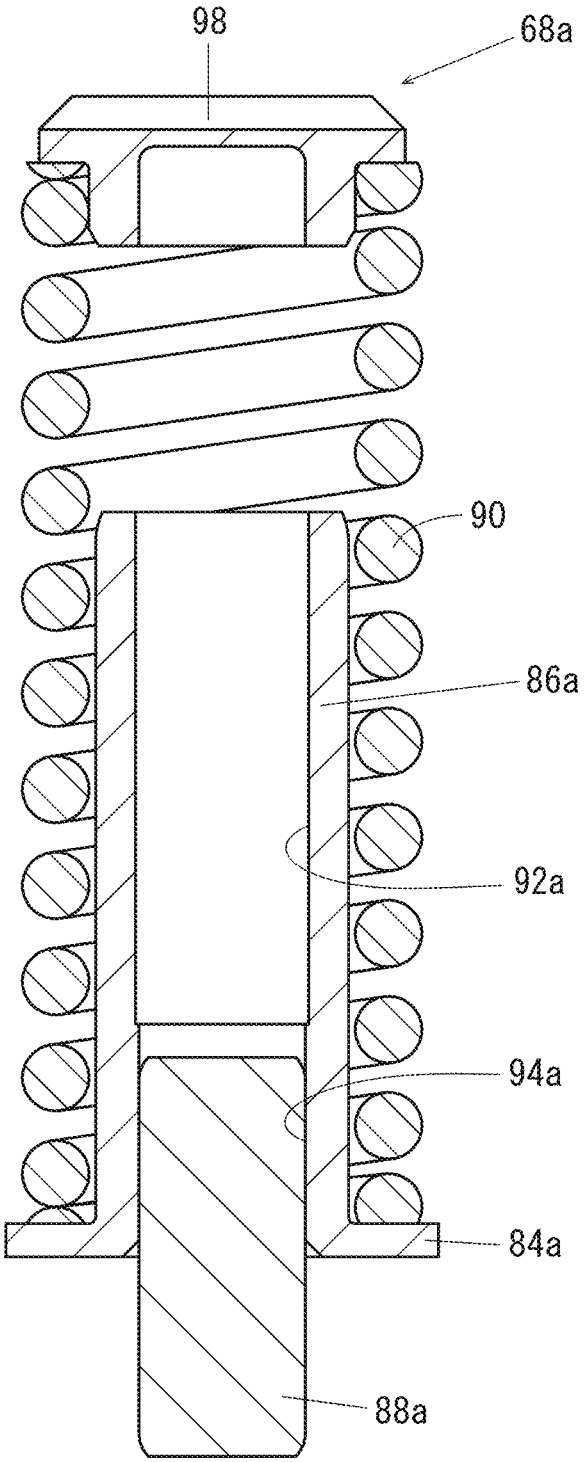
FIG. 14 is a sectional view which shows another example of the lost motion mechanism.

FIG. 14 shows a lost motion mechanism 68*a* as another example.

The lost motion mechanism 68*a* differs from the lost motion mechanism 68 in that it includes a seat 84*a*, a pillar 86*a*, and a pin 88*a* in place of the seat 84, the pillar 86, and the protrusion 88. The seat 84*a* has the shape of a hollow disc. The seat 84*a* includes a first main surface provided with the pillar 86*a* which includes a hollow portion 92*a*. The seat 84*a* and the pillar 86*a* include a through portion 94*a* which extends from a second main surface of the seat 84*a* to the hollow portion 92*a* of the pillar 86*a*. The pin 88*a* has a columnar shape, and is fitted into the through portion 94*a*. In this state, a portion of the pin 88*a* protrudes from a lower main surface of the seat 84*a*, and this portion defines and functions as a columnar protrusion. The seat 84*a*, the pillar 86*a*, and the pin 88*a* are coaxial with each other. Other features of the lost motion mechanism 68*a* are the same as of the lost motion mechanism 68.

According to the lost motion mechanism 68*a*, the pin 88*a* includes a portion which functions as the columnar protrusion, and this portion is on the opposite side of the seat 84*a* from the lost motion spring 90. Therefore, it is possible to fix the lost motion mechanism 68*a* to the cylinder head 16 only by providing the cylinder head 16 with the recess 52*a* (52*b*) which is fittable to the columnar protrusion, and fitting the columnar protrusion into the recess 52*a* (52*b*) of the cylinder head 16. Also, since the recess 52*a* (52*b*) of the cylinder head 16 may be made as a small, columnar depression corresponding to the columnar protrusion, there is no need to increase the thickness of the cylinder head 16 where the lost motion mechanism 68*a* is to be attached.

Figure 15:
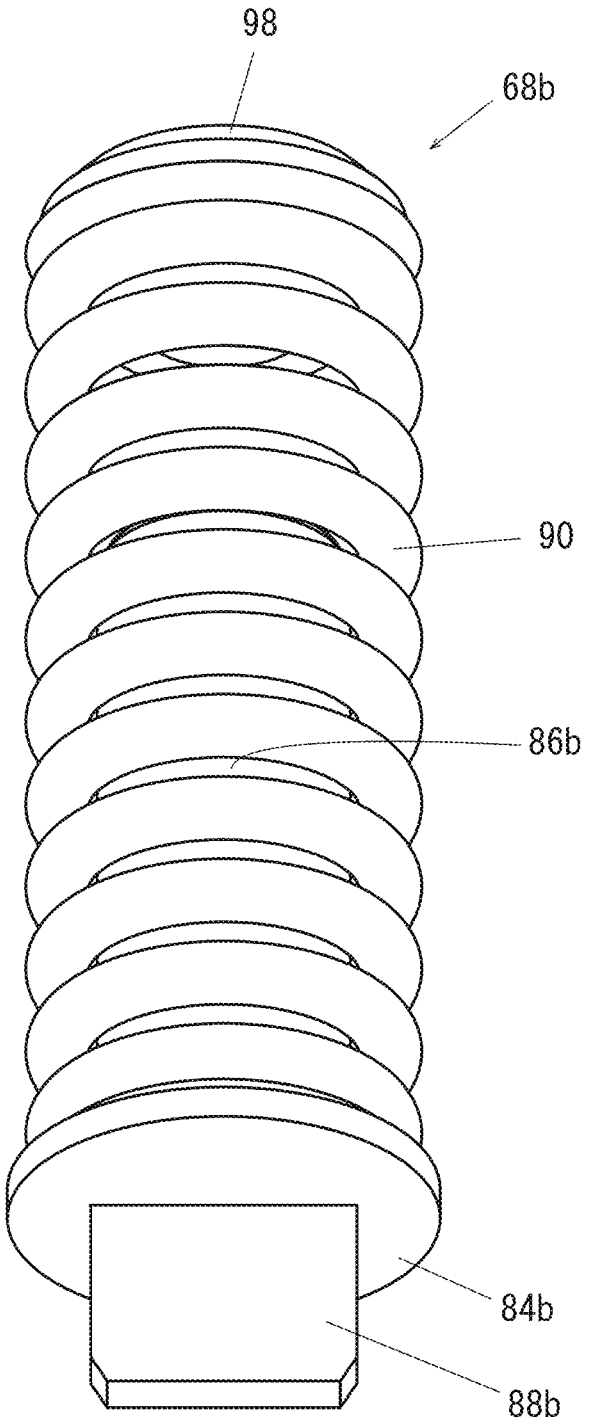
FIG. 15 is a perspective view which shows still another example of the lost motion mechanism.

FIG. 15 shows a lost motion mechanism 68*b* as another example.

The lost motion mechanism 68*b* differs from the lost motion mechanism 68 in that it includes a seat 84*b*, a pillar 86*b*, and a protrusion 88*b* in place of the seat 84, the pillar 86, and the protrusion 88, and that it does not include the through portion 94. The seat 84*b* has the shape of a disc. The seat 84*b* includes a first main surface provided with the pillar 86*b* which includes a hollow portion (not illustrated), while the seat 84*b* includes a second main surface provided with the protrusion 88*b* which is plate-shaped. Other features of the lost motion mechanism 68*b* are the same as of the lost motion mechanism 68.

In order to attach the protrusion 88*b* of the lost motion mechanism 68*b* to a cylinder head, the cylinder head is provided with a recess fittable to the protrusion 88*b*. Then, by fitting the protrusion 88*b* into the recess of the cylinder head, the lost motion mechanism 68*b* is attached to the cylinder head.

According to the lost motion mechanism 68*b*, the plate-shaped protrusion 88*b* is provided on the opposite side of the seat 84*b* from the lost motion spring 90. Therefore, it is possible to fix the lost motion mechanism 68*b* to the cylinder head only by providing the cylinder head with the recess which is fittable to the plate-like protrusion 88*b*, and fitting the protrusion 88*b* into the recess of the cylinder head. Also, the recess of the cylinder head may be a depression having a narrow and elongated section corresponding to the plate-shaped protrusion 88*b*. Therefore, it is possible to attach the lost motion mechanism 68*b* even to a narrow area of the cylinder head.

Figure 16:
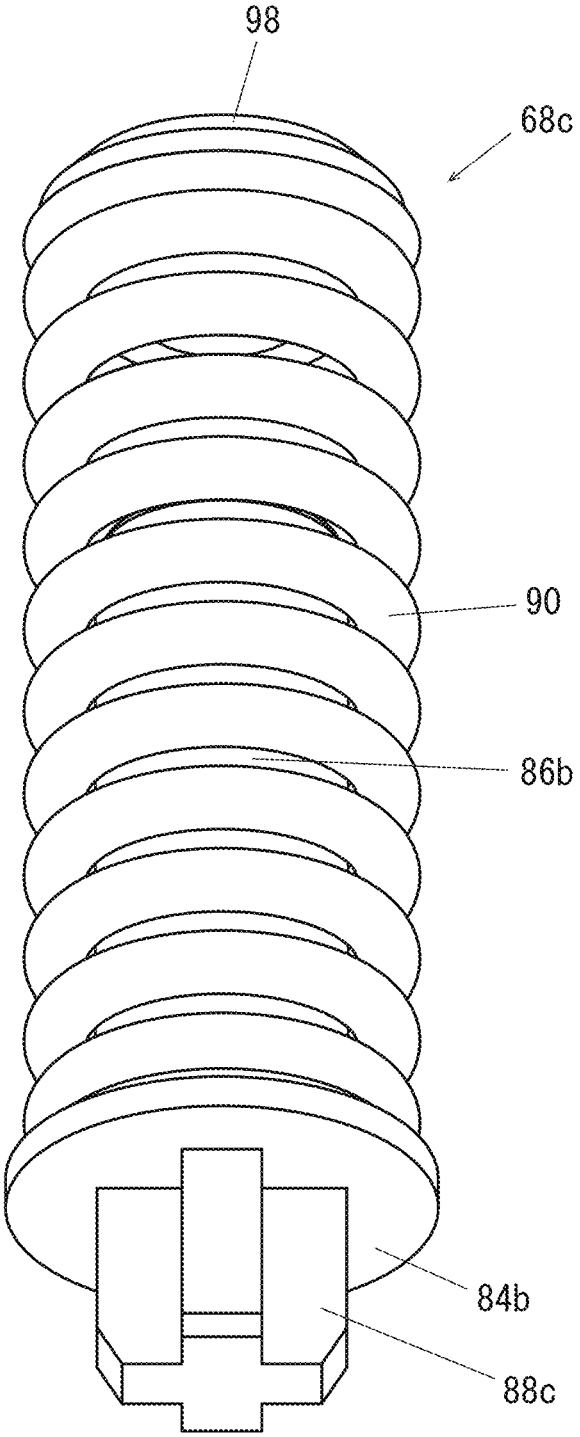
FIG. 16 is a perspective view which shows still another example of the lost motion mechanism.

FIG. 16 shows a lost motion mechanism 68*c* as still another example.

The lost motion mechanism 68*c* differs from the lost motion mechanism 68*b* in that it includes a protrusion 88*c* which has a cross-shaped section, in place of the protrusion 88*b*. Other features of the lost motion mechanism 68*c* are the same as of the lost motion mechanism 68*b*.

In order to attach the protrusion 88*c* of the lost motion mechanism 68*c* to a cylinder head, the cylinder head is provided with a recess having a cross-shaped section. Then, by fitting the protrusion 88*c* into the recess of the cylinder head, the lost motion mechanism 68*c* is attached to the cylinder head.

According to the lost motion mechanism 68*c*, the protrusion 88*c* having a cross-shaped section is provided on the opposite side of the seat 84*b* from the lost motion spring 90. Therefore, it is possible to fix the lost motion mechanism 68*c* to the cylinder head reliably by providing the cylinder head with the recess which is fittable to the protrusion 88*c* which has the cross-shaped section, and fitting the protrusion 88*c* into the recess of the cylinder head.

Figure 17:
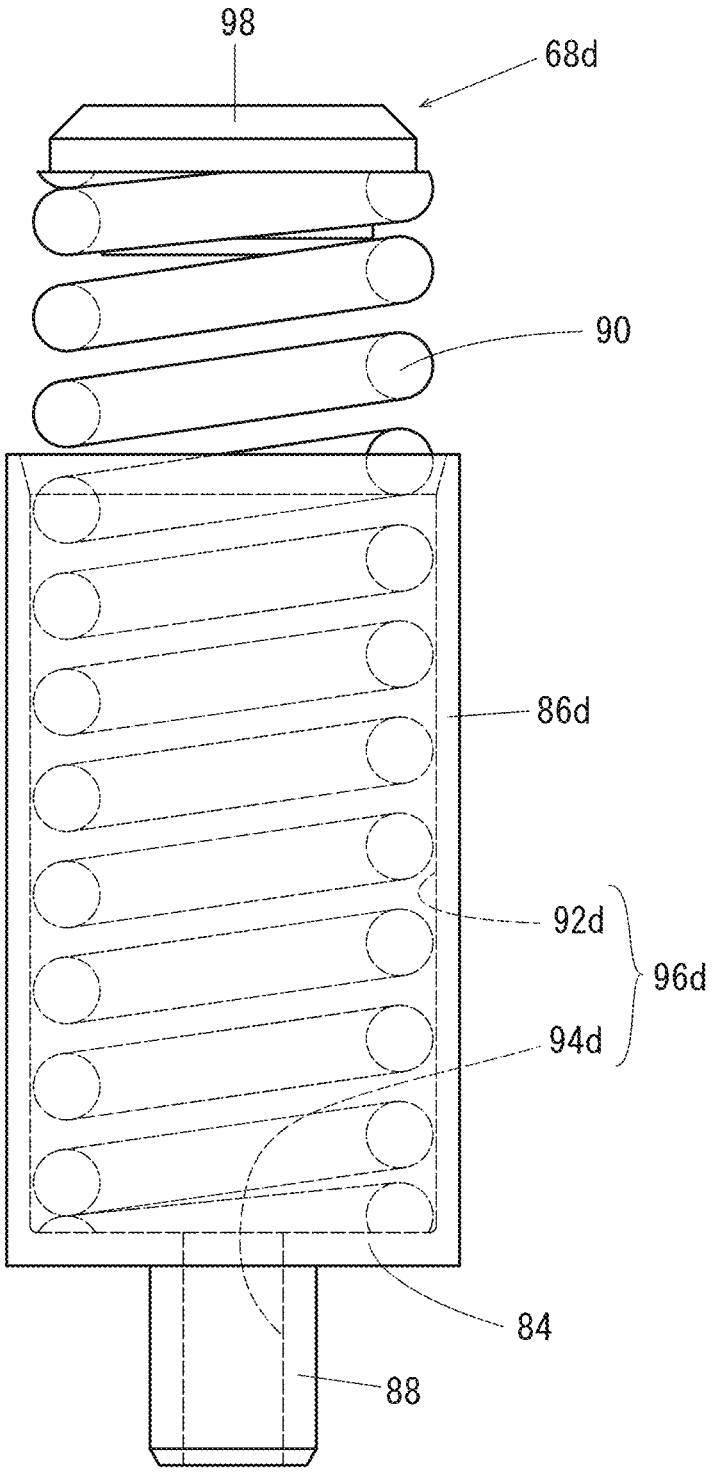
FIG. 17 is a front view which shows still another example of the lost motion mechanism.
Figure 18:
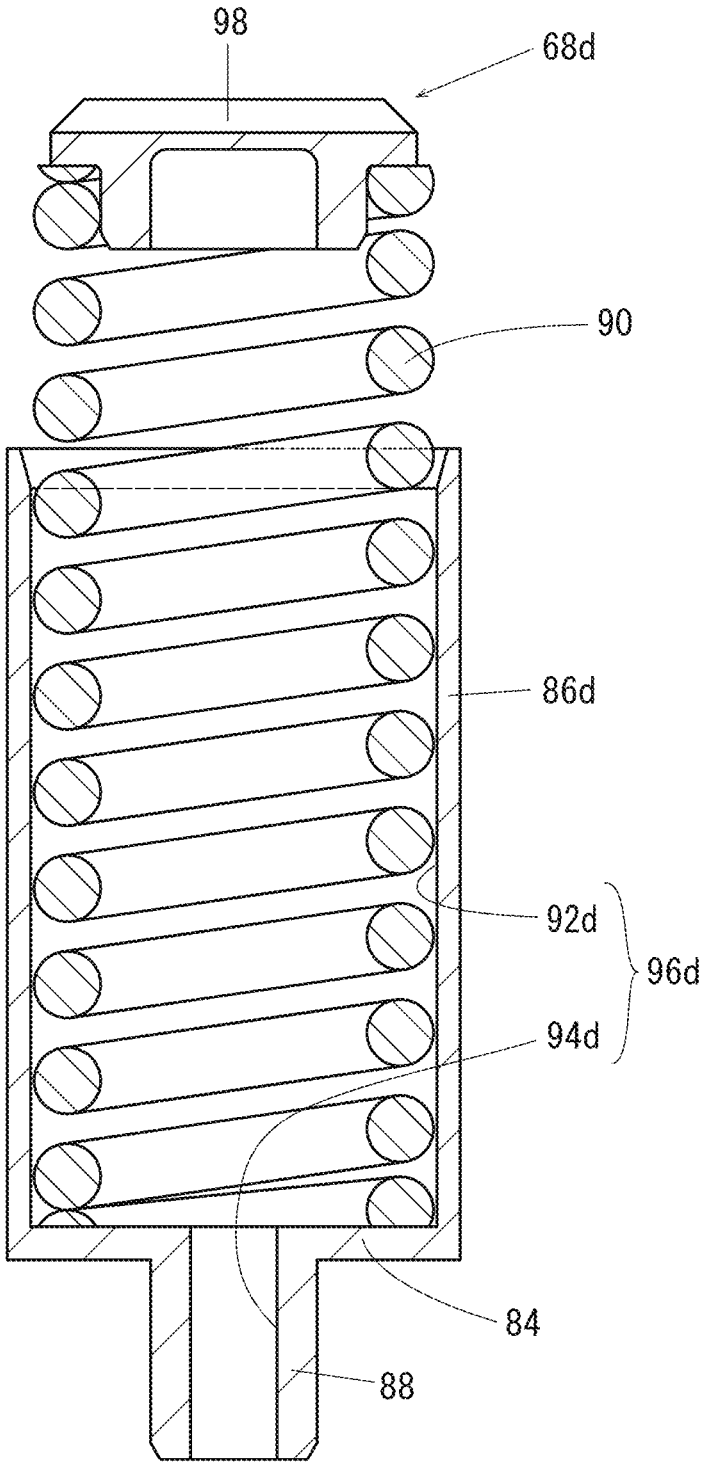
FIG. 18 is a sectional view which shows another example of the lost motion mechanism.

FIG. 17 and FIG. 18 show a lost motion mechanism 68*d* as still another example.

The lost motion mechanism 68*d* differs from the lost motion mechanism 68 in that it includes a cylindrical member 86*d* and a through portion 94*d* in place of the pillar 86 and the through portion 94. The cylindrical member 86*d* functions as the regulator, includes a hollow portion 92*d*, and is provided on the seat 84 so as to cover (surround) the lost motion spring 90. The seat 84 and the protrusion 88 include a through portion 94*d* which extends from a tip portion of the protrusion 88 to the hollow portion 92*d* of the cylindrical member 86*d*. Therefore, the hollow portion 92*d* and the through portion 94*d* define a through-hole 96*d* which penetrates the seat 84, the cylindrical member 86*d*, and the protrusion 88. In the lost motion mechanism 68*d*, the lost motion spring 90 is inserted into the cylindrical member 86*d* until an end portion of the lost motion spring 90 makes contact with the seat 84. Other features of the lost motion mechanism 68*d* are the same as of the lost motion mechanism 68.

According to the lost motion mechanism 68*d*, the cylindrical member 86*d* covers (surrounds) the lost motion spring 90, and therefore it is possible to protect the lost motion spring 90 by the cylindrical member 86*d*, and to effectively limit the bending of the lost motion spring 90.

In the preferred embodiments described above, the attaching portion provided in the support is a protrusion. However, preferred embodiments of the present invention are not limited to this. For example, the attaching portion may be a recess. In this case, the cylinder head is provided with a protrusion that fits into the recess. Also, the attaching portion may include both a protrusion and a recess. In this case, the cylinder head is provided with a recess and a protrusion to fit around the protrusion and into the recess, respectively.

In the preferred embodiments described above, the support (the seat) is located on a lower side and the lid is located on an upper side when the lost motion mechanism is provided in cylinder head. However, preferred embodiments of the present invention are not limited to this. For example, the lost motion mechanism may be provided in a different portion of the engine other than the cylinder head. Also, there may be an arrangement that the support is located on the upper side, the lid is located on the lower side, and the support makes contact with an upper end portion of the lost motion spring when the lost motion mechanism is provided in the portion of the engine.

The preferred embodiments described thus far change the valve lift amount depending on whether or not the first arm portion 70 and the second arm portion 72 are connected with each other. However, preferred embodiments of the present invention are not limited to this. For example, whether or not the first arm portion 70 and the second arm portion 72 are connected with each other may determine whether or not the valve is brought to an inactive state.

In the preferred embodiments described above, the engine 10 is a multi-cylinder engine. However, preferred embodiments of the present invention are not limited to this. Preferred embodiments of the present invention may also be applied to a single-cylinder engine.

The engine according to preferred embodiments of the present invention may also be suitably installed in vehicles such as motorcycles, auto-tricycles, and ATVs (All Terrain Vehicles) as well as outboard engines, and others.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A lost motion mechanism for an engine, the lost motion mechanism comprising:

a lost motion spring;

a regulator extending in an axial direction of the lost motion spring to limit bending of the lost motion spring;

a support extending radially of the lost motion spring from the regulator to make contact with an end portion of the lost motion spring; and an attaching portion including a protrusion provided on the support to attach the support to the engine; wherein the attaching portion does not project out of the support when viewed from the axial direction; and the protrusion is plate-shaped and located on an opposite side of the support from the lost motion spring.

2. The lost motion mechanism according to claim 1, wherein the support includes a seat to support a lower end portion of the lost motion spring;

the attaching portion is located in the seat; and the engine includes a cylinder head to which the attaching portion is to be attached.

3. The lost motion mechanism according to claim 1, wherein the regulator includes a pillar inserted into the lost motion spring.

4. The lost motion mechanism according to claim 3, wherein the pillar includes a hollow portion.

5. The lost motion mechanism according to claim 1, wherein the regulator includes a cylindrical cover to cover the lost motion spring.

6. A valve gear comprising:

the lost motion mechanism according to claim 1.

7. An engine comprising:

the valve gear according to claim 6.

8. A lost motion mechanism for an engine, the lost motion mechanism comprising:

a lost motion spring;

a regulator extending in an axial direction of the lost motion spring to limit bending of the lost motion spring;

a support extending radially of the lost motion spring from the regulator to make contact with an end portion of the lost motion spring; and an attaching portion including a protrusion provided on the support to attach the support to the engine; wherein the attaching portion does not project out of the support when viewed from the axial direction; and the protrusion has a cross-shaped section and is located on an opposite side of the support from the lost motion spring.

9. The lost motion mechanism according to claim 8, wherein the support includes a seat to support a lower end portion of the lost motion spring;

the attaching portion is located in the seat; and the engine includes a cylinder head to which the attaching portion is to be attached.

10. The lost motion mechanism according to claim 8, wherein the regulator includes a pillar inserted into the lost motion spring.

11. The lost motion mechanism according to claim 10, wherein the pillar includes a hollow portion.

12. The lost motion mechanism according to claim 8, wherein the regulator includes a cylindrical cover to cover the lost motion spring.

13. A valve gear comprising:

the lost motion mechanism according to claim 8.

14. An engine comprising:

the valve gear according to claim 13.

15. A lost motion mechanism for an engine, the lost motion mechanism comprising:

a lost motion spring;

a regulator extending in an axial direction of the lost motion spring to limit bending of the lost motion spring;

a support extending radially of the lost motion spring from the regulator to make contact with an end portion of the lost motion spring; and an attaching portion including at least a protrusion or a recess provided on the support to attach the support to the engine; wherein the attaching portion does not project out of the support when viewed from the axial direction; and a through-hole extends through the regulator, the support, and the attaching portion.

16. The lost motion mechanism according to claim 15, wherein the attaching portion includes the protrusion, and the protrusion has a columnar or cylindrical shape, and is located on an opposite side of the support from the lost motion spring.

17. The lost motion mechanism according to claim 15, wherein the support includes a seat to support a lower end portion of the lost motion spring;

the attaching portion is located in the seat; and the engine includes a cylinder head to which the attaching portion is to be attached.

18. The lost motion mechanism according to claim 15, wherein the regulator includes a pillar inserted into the lost motion spring.

19. The lost motion mechanism according to claim 15, wherein the regulator includes a cylindrical cover to cover the lost motion spring.

20. A valve gear comprising:

the lost motion mechanism according to claim 15.

21. An engine comprising:

the valve gear according to claim 20.

* * * * *